US006883455B2

(12) United States Patent
Maeda et al.

(10) Patent No.: US 6,883,455 B2
(45) Date of Patent: Apr. 26, 2005

(54) PERSONAL WATERCRAFT AND BUFFER MEMBER FOR PERSONAL WATERCRAFT

(75) Inventors: Kiyoaki Maeda, Kobe (JP); Kanji Kiyohara, Akashi (JP); Takeru Oshima, Kobe (JP); Yukio Asakura, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/461,204

(22) Filed: Jun. 12, 2003

(65) Prior Publication Data

US 2004/0014374 A1 Jan. 22, 2004

(30) Foreign Application Priority Data

Jun. 17, 2002 (JP) ..... 2002-175439

(51) Int. Cl.[7] ..... B63B 5/24
(52) U.S. Cl. ..... 114/357
(58) Field of Search ..... 114/219, 55.5, 114/357

(56) References Cited

U.S. PATENT DOCUMENTS 3,859,681 A * 1/1975 Mc Vay et al. ..... 114/355
4,627,373 A * 12/1986 Nishida ..... 114/182
4,777,898 A * 10/1988 Faulkner ..... 114/61.1
5,036,789 A * 8/1991 Kelly et al. ..... 114/357
5,921,198 A * 7/1999 Yoshida ..... 114/357

FOREIGN PATENT DOCUMENTS

JP 06-191466 7/1994
JP P2001-180569 A * 7/2001

* cited by examiner

*Primary Examiner*—Stephen Avila
(74) *Attorney, Agent, or Firm*—Alleman Hall McCoy Russell & Tuttle LLP

(57) ABSTRACT

In a personal watercraft and a buffer member of the present invention, a gunnel or the buffer member (bumper) functions as a sponson. An elongate-plate shaped sponson portion is protruded in a lower portion of a corner bumper provided on a side portion of a body along the longitudinal direction of the body. The sponson portion extends such that its longitudinal direction substantially corresponds with the longitudinal direction of the body. A rear end portion of the sponson portion has a width larger than that of a front end portion thereof. The corner bumper functions as the sponson as well as the conventional buffer member.

8 Claims, 9 Drawing Sheets

PERSONAL WATERCRAFT AND BUFFER MEMBER FOR PERSONAL WATERCRAFT

BACKGROUND OF THE INVENTION

1. Field of the Invention

The present invention relates to a personal watercraft having a gunnel or a buffer member that functions as a sponson and the buffer member for the personal watercraft.

2. Description of the Related Art

In recent years, jet-propulsion personal watercraft have been widely used in leisure, sport, rescue activities, and the like. A body of the personal watercraft is comprised of a deck and a hull which are joined to each other at their edge portions, and this joint portion is called a gunnel. The personal watercraft is configured to have a water jet pump that pressurizes and accelerates water sucked from a water intake generally provided on a hull bottom surface and ejects it rearward from an outlet port, thereby obtaining a propulsion force.

A bumper (buffer member) made of synthetic resin is attached to the gunnel to absorb impact. In addition, a sponson (e.g., stabilizer) is attached at a suitable position on the hull which is closer to the bottom than the gunnel, and with the sponson, the personal watercraft gains predetermined cruising characteristics such as stability, during running at a straight-ahead position and cornering.

Japanese Laid-Open Patent Application Publication No. Hei. 6-191466 discloses a body structure of a personal watercraft provided with the buffer member and the sponson which are independently attached to its body.

SUMMARY OF THE INVENTION

In recent years, a personal watercraft has been required to be manufactured with fewer parts and at a reduced cost. The present invention addresses the above-described condition, and an object of the present invention is to provide a personal watercraft that can be manufactured with fewer parts and at a reduced cost by combining a gunnel or a buffer member with a sponson.

According to the present invention, there is provided a water jet propulsion personal watercraft comprising: a deck and a hull joined to each other to form a body of the watercraft; and a single-piece buffer member mounted on a joint portion where the deck and the hull are joined to each other, wherein the single-piece buffer member has a base portion covering the joint portion and a sponson portion extending downwardly from the base portion.

In the water-jet propulsion personal watercraft, the single-piece buffer member is removable from the joint portion.

In the personal watercraft so configured, it is not necessary to independently provide the buffer member and the sponson. Therefore, the personal watercraft can be manufactured with fewer parts, at a reduced cost, and in fewer processes.

In general, the body of the watercraft is formed by joining the deck and the hull while a joint portion of the hull and the deck, called a gunnel, extends over the entire periphery of the side portion of the body. In the personal watercraft so configured, the buffer member may be removably mounted on the gunnel.

In this structure, the buffer member may be easily replaced by the one having a sponson portion that functions according to the rider's preference and purpose of the watercraft. The buffer member may be removably mounted at any suitable location other than the gunnel, and also, in this structure, replacement of the buffer member is easy.

For example, the buffer member may have an elongate base portion and an elongate-plate shaped sponson portion, and the base portion may have a channel-shaped cross-section to be removably externally fitted to the joint portion. The sponson portion is protruded from the base portion such that the longitudinal direction of the sponson portion substantially corresponds with the longitudinal direction of the base portion and has a width increasing from one end portion (fore side) toward the other end portion (aft side) in the longitudinal direction. With the buffer member mounted on the joint portion, the sponson portion extends downwardly from the base portion toward the bottom of the watercraft.

The buffer member functions as the sponson and gains a cruising characteristic similar to that of the sponson provided on the conventional personal watercraft.

Part (a region) of the joint portion extending over the entire periphery of the body may be formed into the sponson portion. This also eliminates a need for an independent sponson as an added part. As a result, the personal watercraft can be manufactured with fewer parts, at a reduced cost, and in fewer processes.

For example, the part of the joint portion may extend downwardly toward the bottom, or part of the deck and/or part of the hull may extend downwardly toward the bottom to function as the sponson portion. By doing so, the sponson portion may be easily formed.

The above and further objects and features of the invention will more fully be apparent from the following detailed description with accompanying drawings.

DETAILED DESCRIPTION OF THE PREFERRED EMBODIMENT

Hereinafter, an embodiment of a personal watercraft of the present invention will be described with reference to the accompanying drawings.

Figure 1:
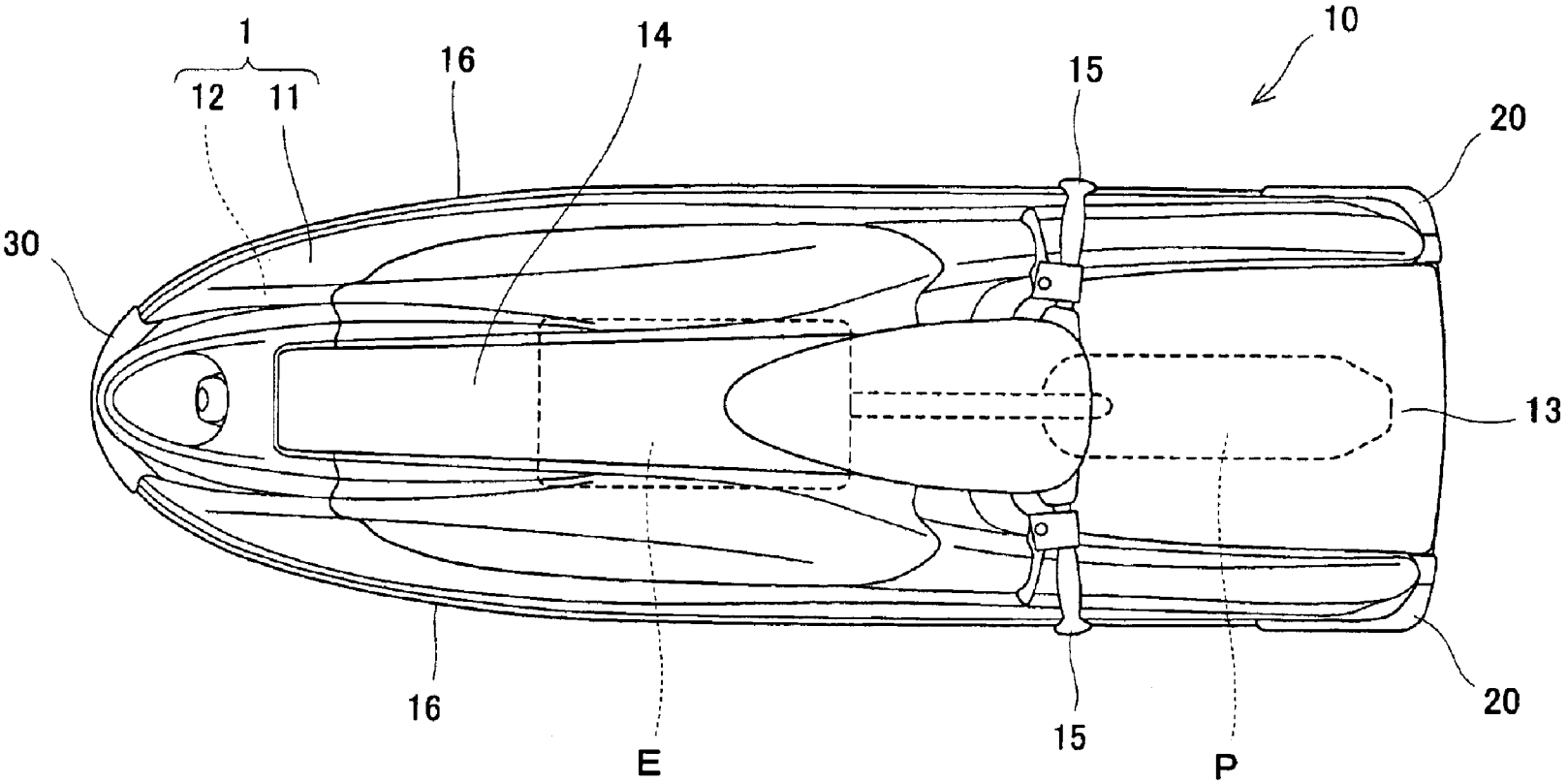
FIG. 1 is a plan view showing a personal watercraft according to an embodiment of the present invention.
Figure 2:
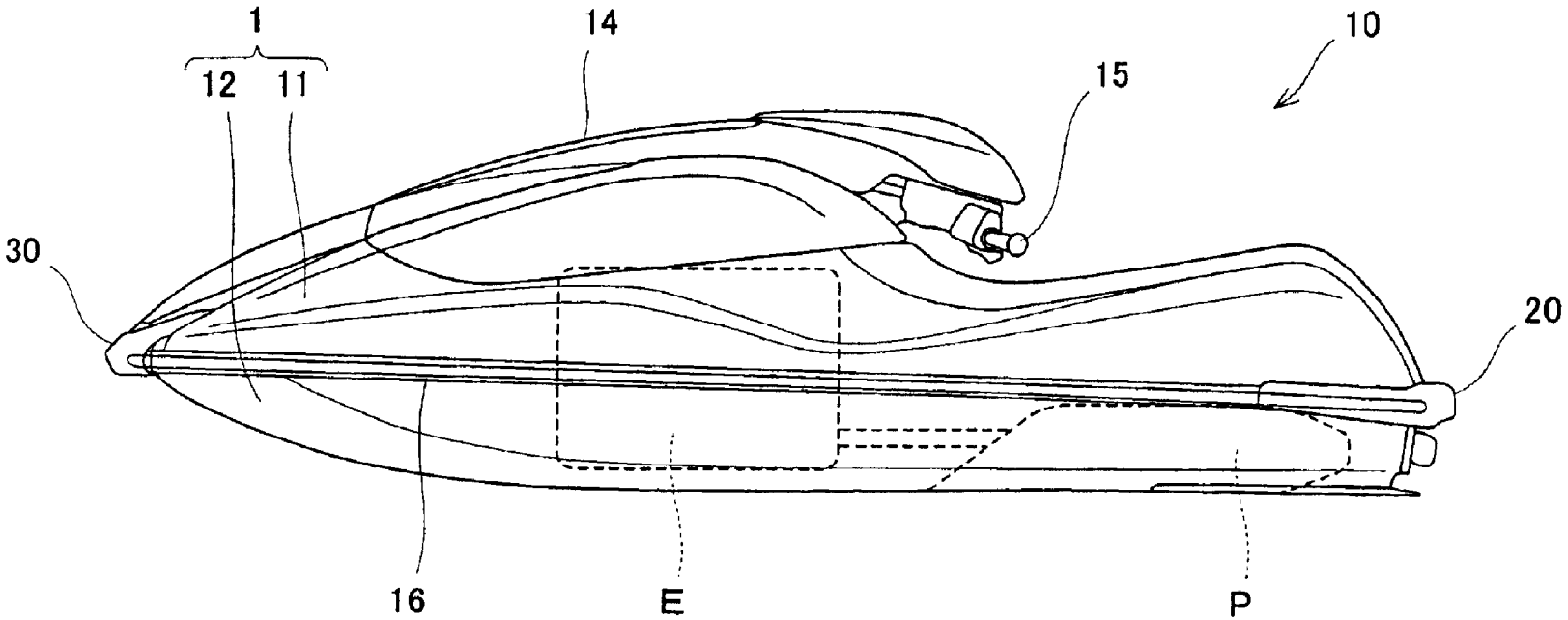
FIG. 2 is a side view showing the personal watercraft in FIG. 1.

Referring to FIGS. 1 and 2, a body 1 of a personal watercraft 10 is formed by joining edge portions of a deck 11 and a hull 12. A joint portion of the deck 11 and the hull 12 forms a gunnel 16 over the entire periphery of the body 1. The body 1 is shaped to be laterally symmetric with respect to a longitudinal axis (axis extending from a fore to an aft) as seen in a plan view. The body 1 has a substantially pointed front portion.

The deck 11 is provided with a floor 13 at a rear portion thereof on which a rider rides in a standing or kneeling position. A front end of a steering column 14 having a steering handle 15 at a rear end thereof is pivotally mounted on a front portion of the deck 11. The steering column 14 is vertically pivotable around the front end.

As shown in FIG. 1, an engine E is mounted substantially at the center inside the body surrounded by the deck 11 and the hull 12, and a water jet pump P as a propulsion mechanism of the watercraft is mounted behind the engine E. In the personal watercraft 10, the rider rides on the floor 13 and grips the steering handle 15 to operate the watercraft 10. The engine E drives the water jet pump P, which ejects the water rearward, and as the resulting reaction, the watercraft 10 is propelled.

At right and left corners of the rear portion of the watercraft 10, right and left single-piece corner bumpers (buffer members) 20 made of synthetic resin such as polypropylene, are respectively mounted on the gunnel line 16. In addition, a front bumper (buffer member) 30 is mounted on a front portion of the watercraft 10 on the gunnel line 16.

Figure 3:
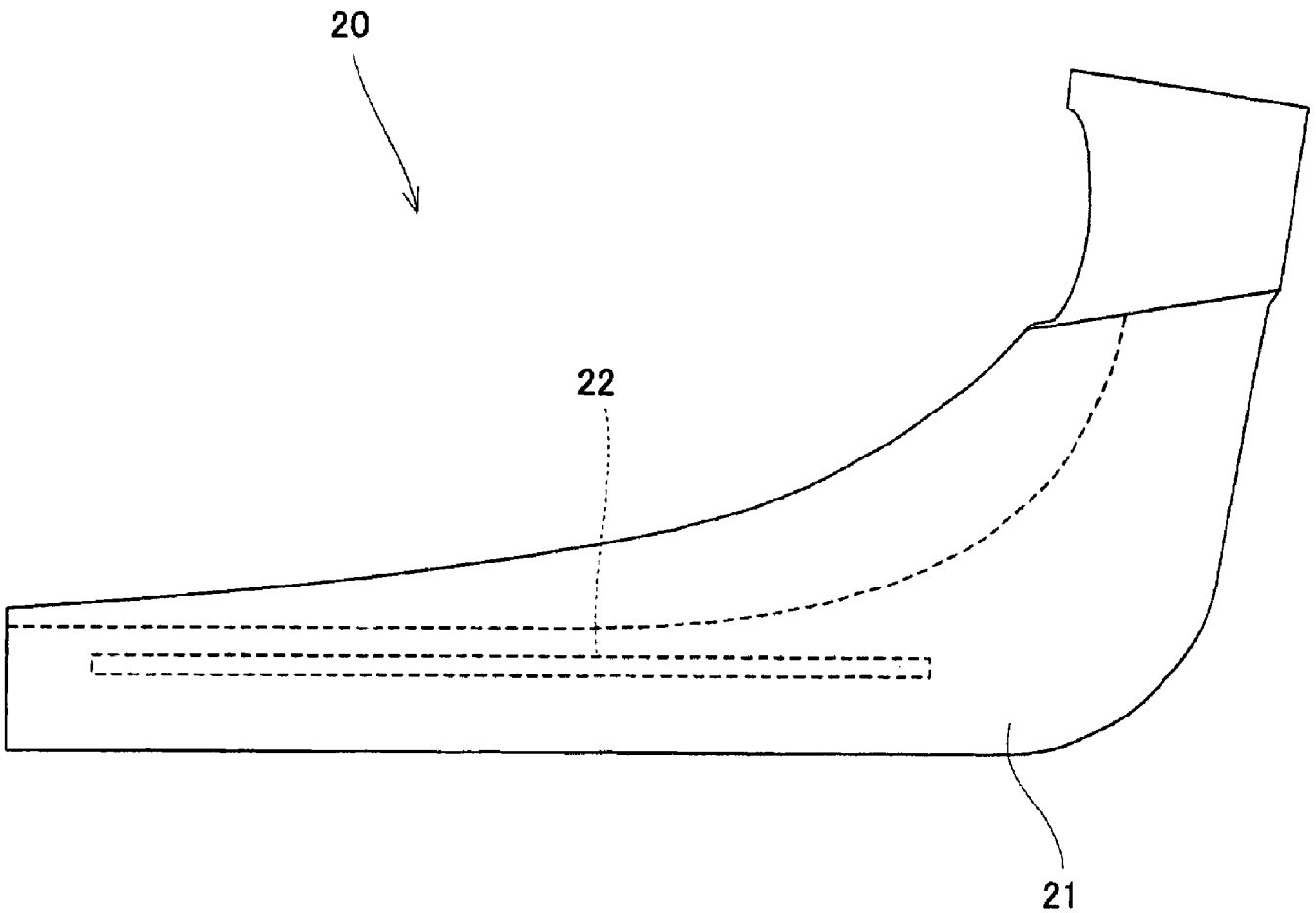
FIG. 3 is a plan view showing a corner bumper attached to a gunnel on a left side of a rear portion of the personal watercraft in FIG. 1.
Figure 4:
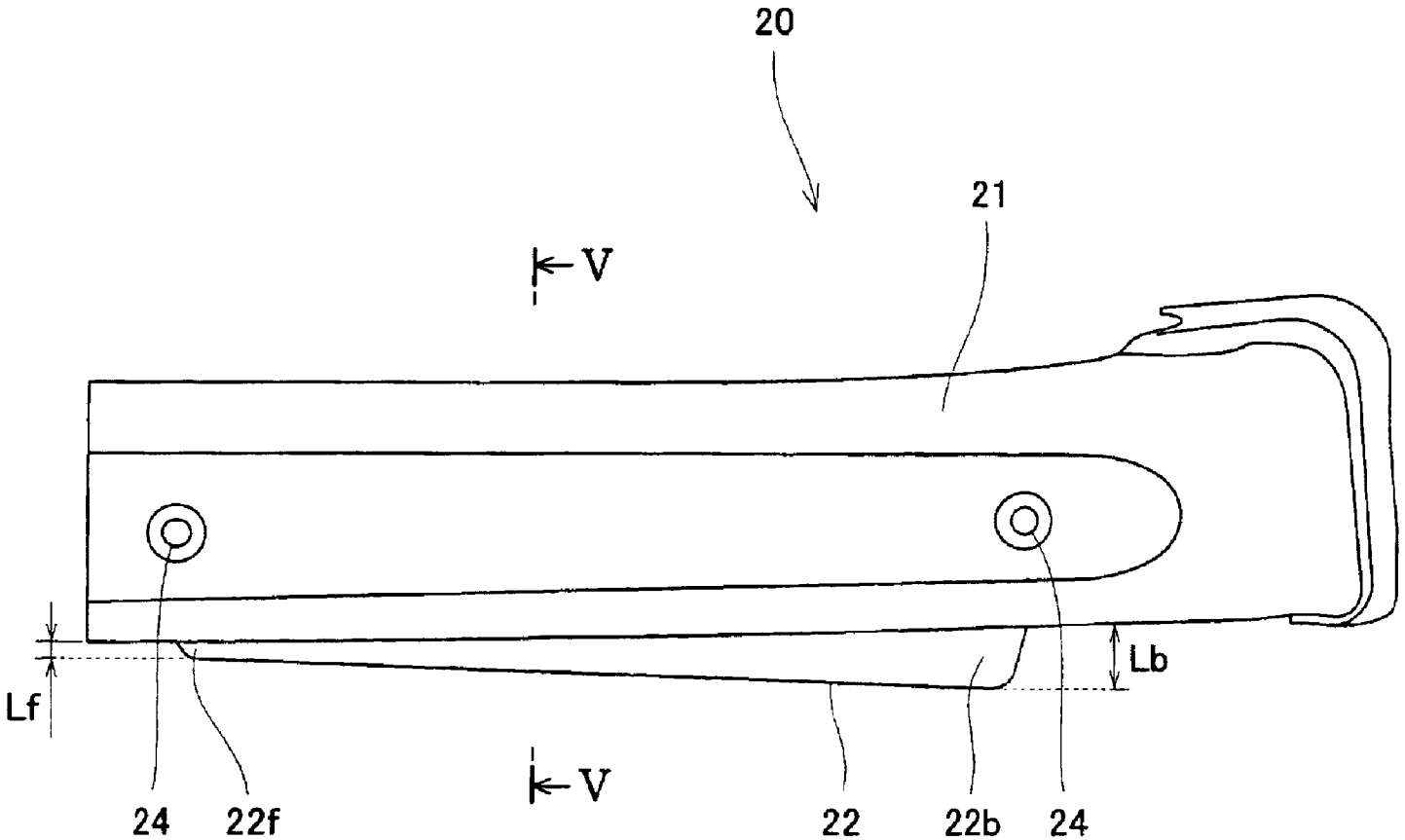
FIG. 4 is a side view showing the corner bumper in FIG. 3.
Figure 5:
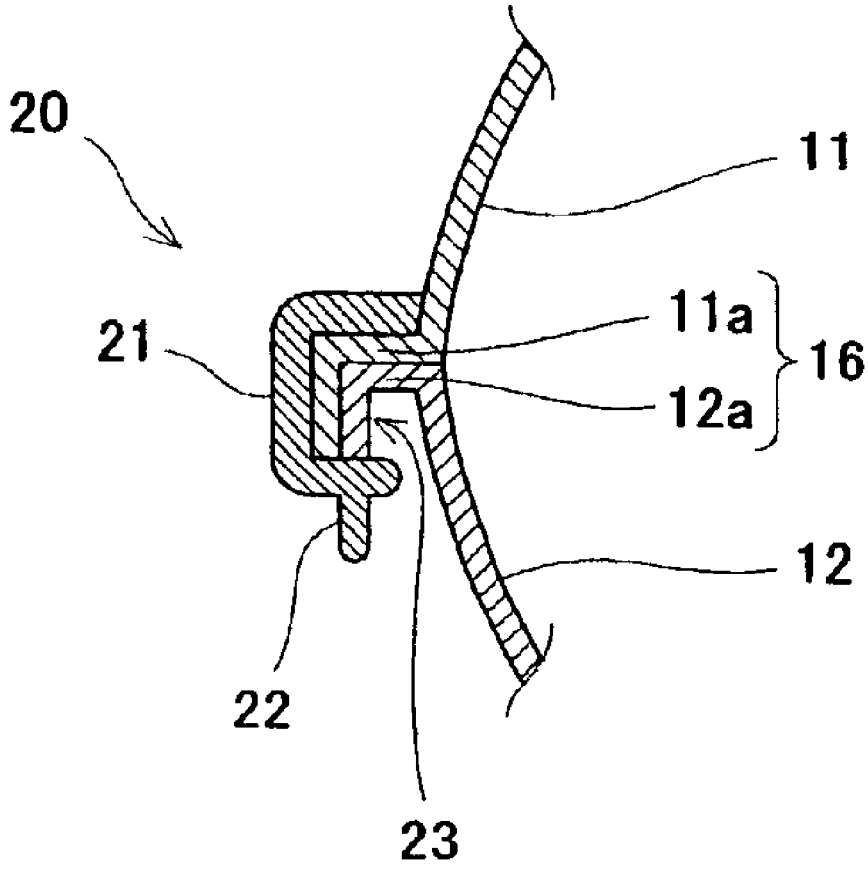
FIG. 5 is a cross-sectional view taken in the direction of arrows along line V—V of the corner bumper in FIG. 4.

As shown in FIGS. 3 and 4, each single-piece corner bumper 20 is comprised of an elongate base portion 21, which is bent in the vicinity of an end thereof to be substantially L-shaped as seen in a plan view and an elongate-plate shaped sponson portion 22 protruded from the base portion 21 such that its longitudinal direction corresponds with the longitudinal direction of the base portion 21. As shown in FIG. 5, the base portion 21 is provided with a groove 23 on a side portion thereof to extend along the longitudinal direction of the base portion 21. The base portion 21 has a channel-shaped cross-section (cross-section perpendicular to the longitudinal direction). Specifically, the cross-section of the base portion 21 is shaped like a horseshoe to form an opening in the direction corresponding with the direction toward which the base portion 21 is bent.

As shown in FIGS. 3 and 4, the sponson portion 22 is protruded to cross the direction toward which the base portion 21 is bent. The elongate-plate shaped sponson portion 22 has a width increasing from one end portion 22*f* of the base portion 21 toward the other end portion 22*b* located in the vicinity of the bent portion of the base portion 21. As shown in FIG. 4, a width Lb of the other end portion 22*b* is larger than a width Lf of the one end portion 22*f*. The sponson portion 22 and the base portion 21 may be integrally formed.

As shown in FIG. 5, protrusions 11*a* and 12*a*, i.e., a joint portion 11*a* and 12*a* where the deck 11 and the hull 12 are joined to each other, are laterally protruded from edge portions of the deck 11 and the hull 12 forming the gunnel 16 so as to be substantially inverted L-shaped. The protrusions 11*a* and 12*a* conform in shape to each other and are joined by means of screws or a bonding agent, thus forming the gunnel 16.

Each of the corner bumpers 20 covers the right or left corner of the rear end of the gunnel 16 in such a manner that the base portion 21 conforms to the corner at the rear end of the body and the groove 23 is externally fitted to the protrusions 11*a* and 12*a*. More specifically, the corner bumper 20 covers the gunnel 16 such that the one end portion 22*f* of the sponson portion 22 with a smaller width is located on the fore side and the other end portion 22*b* of the sponson portion 22 with a larger width is located on the aft side. The corner bumper 20 is removably fastened to the gunnel 16 by means of bolts 24 (see FIG. 4).

With the corner bumpers 20 mounted on the gunnel 16, the sponson portions 22 extend downwardly from the base portions 21 toward the bottom of the watercraft 10. Typically, the corner bumpers 20 formed on the right and left sides of the rear end of the body are laterally symmetric. While the corner bumpers 20 cover the gunnel 16 such that the grooves 23 are externally fitted to the gunnel 16 and are then fastened to the gunnel 16 by means of the bolts, they may be configured not to have the grooves 23 and to be fastened to the gunnel 16 by means of the bolts, or they may be fastened to the gunnel 16 or other suitable component by adhesive bond or other suitable means.

The corner bumpers 20 function as the conventional bumpers and the conventional sponson independently provided. Specifically, during cruising of the watercraft, the sponson portions 22 of the corner bumpers 20 make contact with the water or are submerged so as to receive a reaction force according to their shape, thereby stabilizing a posture of the body.

It is known that a dimension of the downwardly protruded portion of the sponson portion 22 affects a cornering characteristic of the watercraft 10 with the corner bumpers 20 attached to the gunnel 16. It is also known that a lateral distance of the sponson portion 22 from a streamlined surface of the hull 12 affects straight-ahead position of the watercraft 10.

Figure 6:
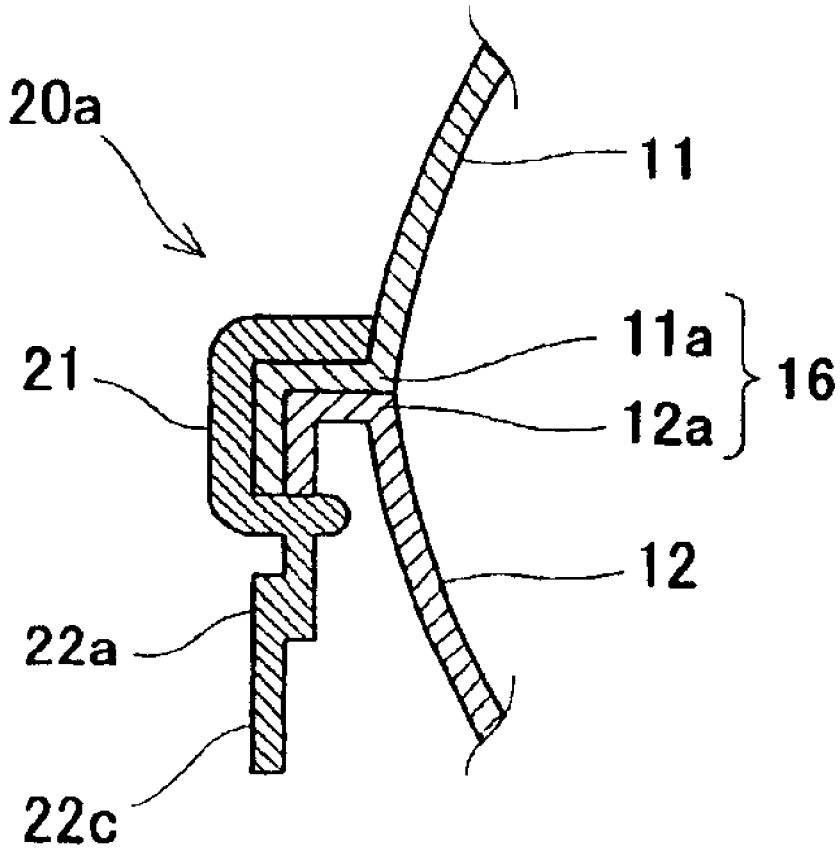
FIG. 6 is a cross-sectional view of a corner bumper having another cross-sectional shape.
Figure 7:
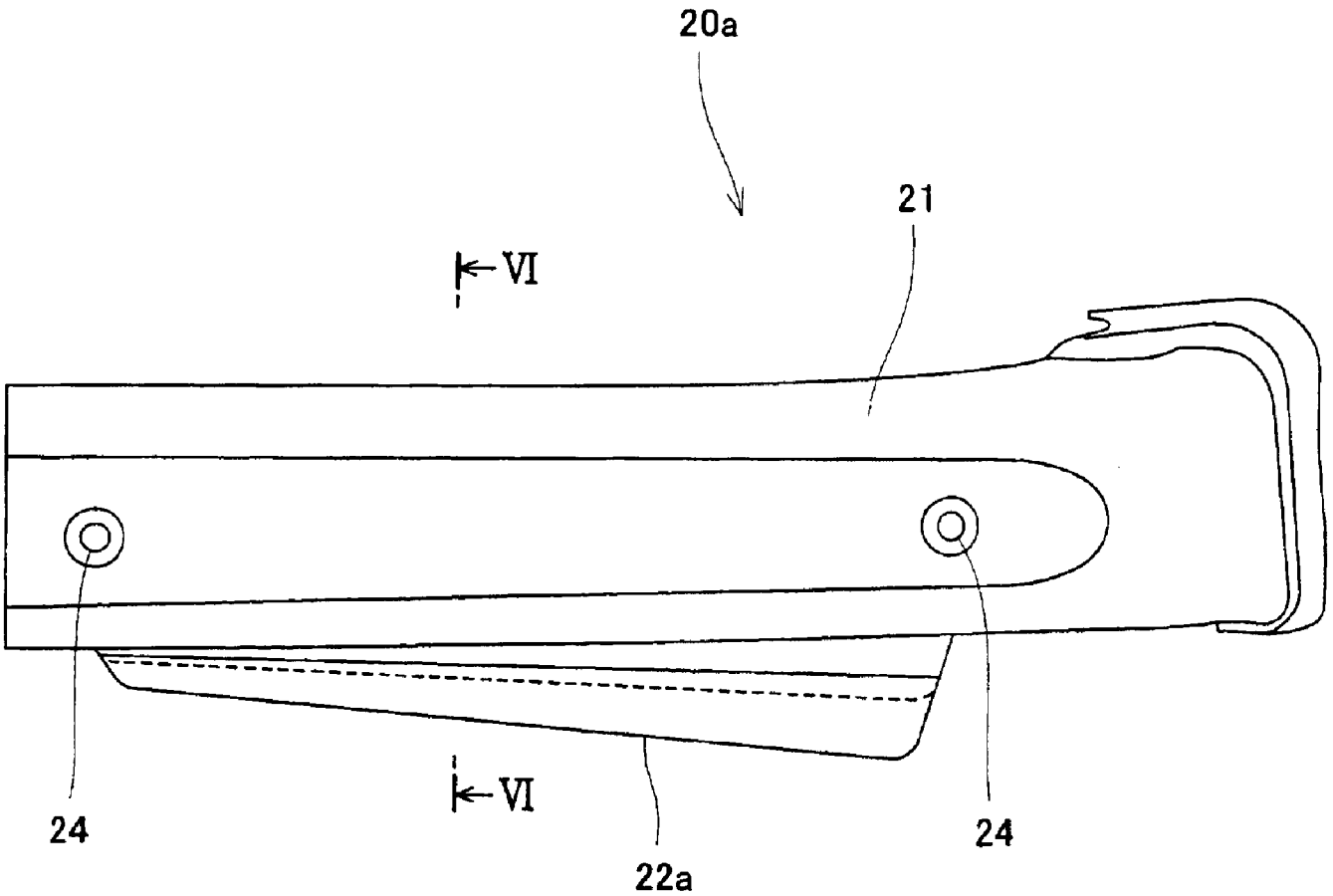
FIG. 7 is a side view showing the corner bumper in FIG. 6.

Referring to FIGS. 6 and 7, corner bumpers 20*a* are shown as having a structure different from that of the corner bumpers 20 in FIG. 5. Specifically, the corner bumpers 20*a* in FIGS. 6 and 7 differ in structure of the sponson portions from the corner bumpers 20 in FIG. 5. As shown in FIG. 6, with the corner bumper 20*a* mounted on the gunnel 16, a sponson portion 22*a* of the corner bumper 20*a* has an elongate plate member 22*c* extending from a lower portion of an outer side face of the sponson portion 22 in FIG. 5. The elongate plate member 22*c* has a shape similar to that of the sponson portion 22.

As shown in FIGS. 6 and 7, the sponson portion 22*a* is configured such that the longitudinal direction of the elongate plate member 22*c* corresponds with the longitudinal direction of the sponson portion 22 in FIG. 5 and an upper portion of a side face of the elongate plate member 22*c* is connected to a lower portion of an outer side face of the sponson portion 22.

As shown in FIGS. 6 and 7, with the corner bumper 20*a* mounted on the gunnel 16, the dimension of the downwardly protruded portion of the sponson portion 22*a* is larger than that of the sponson portion 22. The difference in the dimension of the downwardly protruded portion and in the lateral distance from the streamline surface of the hull 12 between the sponson portion 22 and the sponson portion 22*a*, results in different cruising characteristics of the watercraft 10. As in the sponson portion 22 in FIG. 5, the sponson portion 22*a* in FIGS. 6 and 7 has a width increasing from the fore side toward the aft side with the corner bumper 20*a* mounted to cover the gunnel 16.

The corner bumper 20 mounted on the personal watercraft 10 is replaced by the corner bumper 20*a* by removing the bolts 24 from the gunnel 16 in FIG. 4. In this manner, in the personal watercraft 10 according to this embodiment, the corner bumpers can be easily changed into those having the sponson portions having a suitable shape according to the user's preference or the purposes of the watercraft 10.

While the above corner bumpers function as the sponson, the gunnel can also function as the sponson by devising its shape. In that case, in the watercraft 10 in FIG. 1, part of the gunnel 16 on which the corner bumpers 20 are mounted, i.e., right and left rear portions of the body, are devised. In this structure, the corner bumpers having the sponson portions in FIGS. 3 to 7 become unnecessary.

Figure 8:
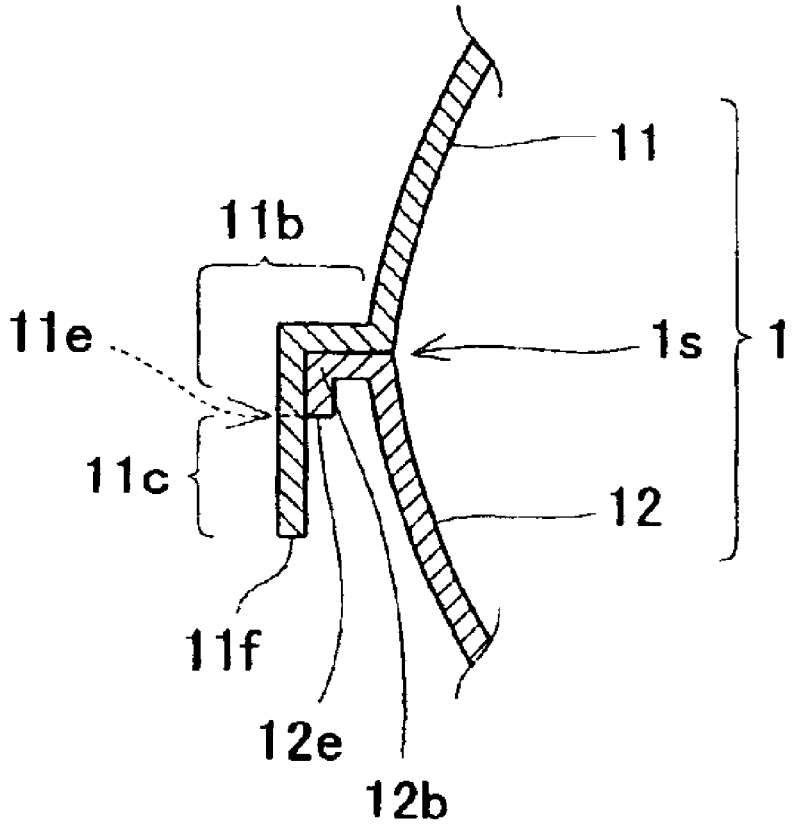
FIG. 8 is a cross-sectional view showing an example of a gunnel that functions as a sponson.
Figure 9:
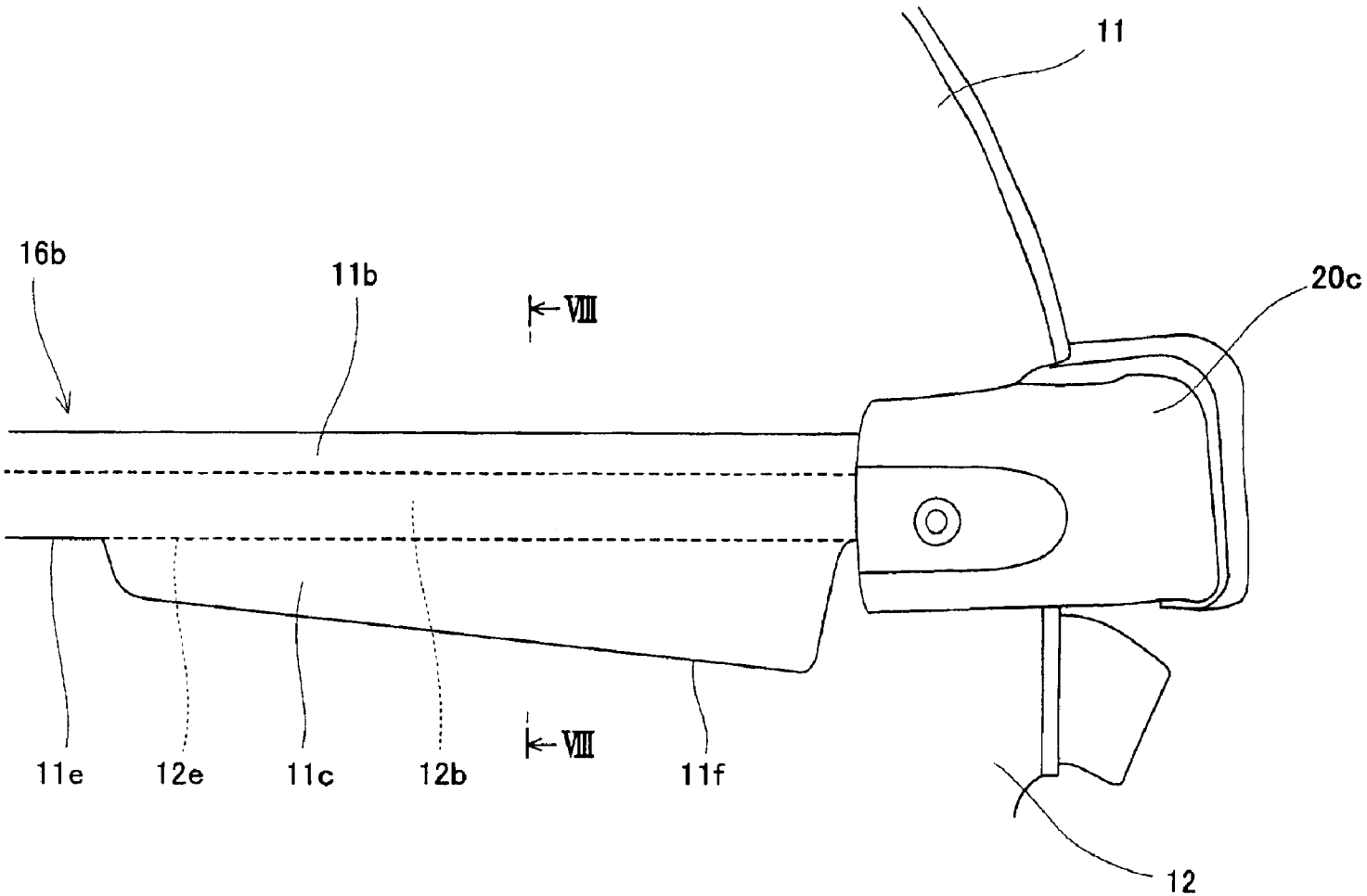
FIG. 9 is a side view showing the gunnel in FIG. 8.

FIGS. 8 and 9 show an example. As shown in FIG. 8, the deck 11 and the hull 12 are provided with protrusions 11*b* and 12*b* (a joint portion 11*b* and 12*b* where the deck 11 and the hull 12 are joined to each other) over an entire periphery of a side portion 1*s* of the body 1. The protrusions 11*b* and 12*b* are substantially identical to the protrusions 11*a* and 12*a* in FIG. 5 in that the protrusions 11*b* and 12*b* are laterally protruded from the body to be substantially inverted L-shaped and conform in shape to each other to form a gunnel 16*b*. As shown in FIG. 8, an extension portion 11*c* (hereinafter referred to as a "sponson portion") extends downwardly from a deck edge 11*e* of the protrusion 11*b* (joint portion 11*b*) such that its lower edge 11*f* is located lower than a hull edge 12*e* of the protrusion 12*b* (joint portion 12*b*) within the partial length of the entire periphery of the gunnel line 16 (see FIG. 9).

Specifically, in addition to providing the protrusions 11*b* and 12*b* of the gunnel 16*b*, the sponson portion 11*c* of the gunnel 16*b* protrudes downwardly toward the bottom of the watercraft 10 such that its lower edge 11*f* is located lower by a predetermined distance than the hull edge 12*e*. As shown in FIG. 9, a width of the sponson portion 11*c*, i.e., a dimension of the protruded portion of the sponson portion 11*c* increases from the fore side toward the aft side. Also, as shown in FIG. 9, a corner bumper 20*c* covers a corner portion of the rear end of the gunnel 16*b*.

During cruising, the sponson portion 11*c* protruded downwardly from the deck edge 11*e* of the protrusion 11*b* makes contact with the water surface or is submerged so as to receive a reaction force according to its dimension and shape, thereby functioning to stabilize a posture of the body of the watercraft.

As described above with reference to FIGS. 5 to 7, the sponson portion 11*c* of the gunnel 16*b* can be shaped variously according to the user's preference or the purposes of the watercraft 10. The sponson portion 11*c* may be provided on the lower end of the protrusion 12*b* having a suitable dimension and shape, or a pair of the sponson portions 11*c* may be provided on the lower ends of the protrusion 11*b* and the protrusion 12*b*.

Instead of the stand-up type watercraft in FIGS. 1 and 2, the present invention may be applied to a straddle-type watercraft provided with a seat which the rider straddles.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A water-jet propulsion personal watercraft comprising:

a body formed by a hull arid a deck covering the hull from above, the body having a gunnel formed by a joint portion joining the hull and the deck over an entire periphery thereof and configured to protrude outwardly from a side wall of the hull, and a space inside thereof configured to accommodate an engine for the watercraft; and a single-piece buffer member mounted on the gunnel at a rear portion of a side portion of the body, wherein the single-piece buffer member has a protection portion covering at least an outer portion of the gunnel, to protect the gunnel and a plate-shaped extension portion extending downwardly from the protection portion by a predetermined length from a lower end of the gunnel and by a predetermined length in a longitudinal direction of the body such that the extension portion is spaced a predetermined distance apart from the side wall of the hull below the gunnel.

2. The water-jet propulsion personal watercraft according to claim 1, wherein the single-piece buffer member is removably attachable to the gunnel.

3. The water-jet propulsion personal watercraft according to claim 2, wherein the single-piece buffer member has a groove portion provided in the protection portion to extend in a longitudinal direction of the protection portion, the groove portion being externally fitted to the gunnel to allow the protection portion to be removably attachable to the gunnel; and the protection portion has a hole, wherein the single-piece buffer member is attached to the gunnel by attaching a bolt inserted into the hole with the groove portion externally fitted to the gunnel.

4. The water-jet propulsion personal watercraft according to claim 3 wherein the extension portion has a vertical dimension increasing from a fore side toward an aft side of the body.

5. The water-jet propulsion personal watercraft according to claim 1, wherein the extension portion has a vertical dimension increasing from a fore side toward an aft side of the body.

6. A water-jet propulsion personal watercraft, comprising:

a body formed by a hull and a deck covering the hull from above, the body having a gunnel formed by a joint portion joining the hull and the deck over an entire periphery thereof and configured to protrude outwardly from a side wall of the hull, and a space inside thereof configured to accommodate an engine for the watercraft, wherein the gunnel is formed by joining a hull protruding portion extending outwardly from the side wall of the hull, and a deck protruding portion extending outwardly from a side wall of the deck, the deck protruding portion being configured to cover the hull protruding portion from above, and the gunnel is provided with a plate-shaped extension portion formed on a rear portion of the gunnel to extend downwardly from the gunnel so as to be spaced apart a predetermined distance from the side wall of the hull below the gunnel, the extension portion extending by a predetermined length in a longitudinal direction of the body.

7. The jet-propulsion personal watercraft according to claim 6, wherein the extension portion extends from an outer end portion of the hull protruding portion or an outer end portion of the deck protruding portion.

8. A buffer member for a watercraft having a body formed by a hull and a deck covering the hull from above, the body having a gunnel formed by a joint portion joining the hull and the deck over an entire periphery thereof and configured to protrude outwardly from a side wall of the hull, the buffer member comprising:

an elongate protection portion configured to partially cover the gunnel to protect the gunnel;

a groove portion provided in the elongate protection portion to extend in a longitudinal direction of the elongate protection portion, the groove portion being externally fitted to the gunnel to allow the elongate protection portion to be removably attachable to the gunnel; and an elongate-plate shaped portion protruded downwardly from the elongate protection portion such that a longitudinal direction of the elongate-plate shaped portion substantially corresponds with the longitudinal direction of the elongate protection portion;

wherein the elongate protection portion has a hole into which an attaching bolt is inserted to allow the elongate protection portion to be removably attached to the gunnel; and wherein the elongate-plate shaped portion has a vertical dimension increasing from one end portion toward the other end portion in a longitudinal direction thereof.

* * * * *